US008076859B1

(12) United States Patent
Knoble et al.

(10) Patent No.: US 8,076,859 B1
(45) Date of Patent: Dec. 13, 2011

(54) EMERGENCY SIGN POWER SUPPLY WITH BATTERY CHARGER

(75) Inventors: David W. Knoble, Tupelo, MS (US); Khosrow Jamasbi, Belden, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 392 days.

(21) Appl. No.: 12/327,531

(22) Filed: Dec. 3, 2008

(51) Int. Cl.
*H05B 37/00* (2006.01)

(52) U.S. Cl. ..... 315/185 S; 315/129; 315/131; 315/291; 315/324

(58) Field of Classification Search ..... 315/185 S, 315/224, 225, 247, 291, 307, 324, 312, 129, 315/131, 135, 203–207
See application file for complete search history.

(56) References Cited

U.S. PATENT DOCUMENTS

| | | | |
|---|---|---|---|
| 4,271,408 | A | 6/1981 | Teshima |
| 4,682,147 | A | 7/1987 | Bowman |
| 4,965,457 | A | 10/1990 | Wrobel |
| 5,160,201 | A | 11/1992 | Wrobel |
| 5,303,124 | A | 4/1994 | Wrobel |
| 5,388,357 | A | 2/1995 | Malita |
| 5,688,042 | A | 11/1997 | Madadi |
| 5,847,550 | A | 12/1998 | Schie |
| 6,141,234 | A | 10/2000 | Knoble |
| 6,294,983 | B1 | 9/2001 | Lee |
| 6,663,248 | B2 | 12/2003 | Hsieh |
| 2002/0191396 | A1 | 12/2002 | Reiff |

*Primary Examiner* — Tuyet Thi Vo

(57) ABSTRACT

An emergency sign power supply with battery charger is provided. In some embodiments the battery charging circuit is formed by a single diode and a single resistor.

20 Claims, 2 Drawing Sheets

EMERGENCY SIGN POWER SUPPLY WITH BATTERY CHARGER

CROSS-REFERENCE TO RELATED DOCUMENTS

Not Applicable.

TECHNICAL FIELD

This invention pertains generally to a power supply with a battery charger, and more specifically to an emergency sign power supply with battery charger.

BACKGROUND

Emergency signs include, but are not limited to, exit signs, warning signs, and emergency lights for providing illumination and/or information to individuals during an emergency situation. Emergency signs are often provided with rechargeable batteries that are kept in a charged condition so they may serve as power supplies in the event of a disruption of line power.

BRIEF DESCRIPTION OF THE ILLUSTRATIONS

DETAILED DESCRIPTION

Figure 1:
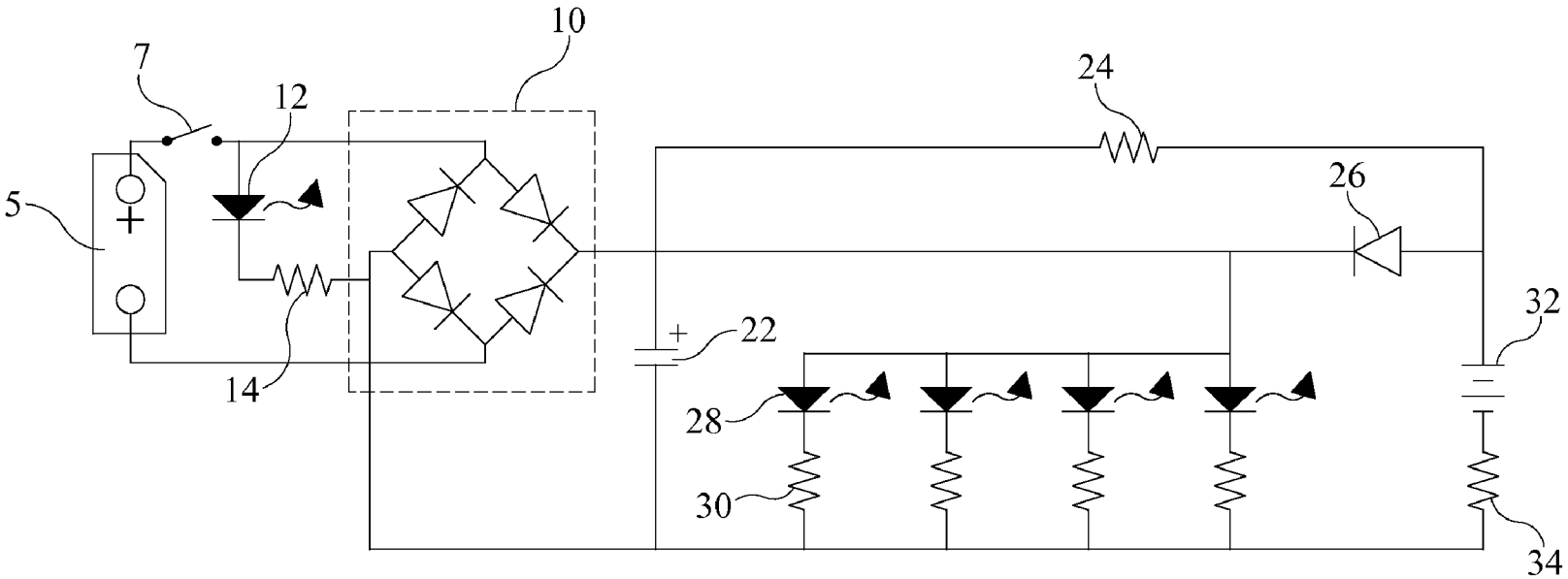
FIG. 1 is a schematic diagram of one embodiment of an emergency sign power supply with battery charger of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now to FIG. 1, an emergency sign power supply with battery charger is shown. An isolating transformer 5 has two leads each individually coupled to an input of a rectifying bridge 10. Isolating transformer 5 is a constant voltage device and may be connected to a number of line voltages. Rectifying bridge 10 depicted is merely exemplary of one of a plurality of rectifying bridges that may be used. A test switch 7 is interposed between a positive lead of isolating transformer 5 and rectifying bridge 10 and is shown in the open state. Test switch 7 may be placed in the open state to remove isolating transformer 5 from the circuit in order to test the functionality of a rechargeable battery 32. A light emitting diode (LED) 12 and a resistor 14 are connected in series with one another and connected in between the positive lead of isolating transformer 5 and a negative output lead of rectifying bridge 10. When test switch 7 is in the closed position and isolating transformer 5 is receiving line power and functioning correctly, LED 12 will be illuminated, indicating to a user that isolating transformer 5 is currently providing power to the circuit.

A capacitor 22 is shown connected across the positive and negative output leads of rectifying bridge 10. Capacitor 22 smoothes the output from rectifying bridge 10 and may be used to improve performance of the circuit. However, capacitor 22 is not necessary and is not provided in some embodiments. Across the outputs of bridge rectifier 10 are four LED branches, each including a LED 28 in series with a resistor 30. The LED branches are connected in parallel with one another. Although only four LED branches with only one LED 28 in each LED branch are shown in the Figure, the LED branches shown are merely exemplary of one embodiment of the invention. Each LED branch may contain more than one LED 28 and more or less LED branches may be provided. The number of LEDs 28 and the number of LED branches may be based on design considerations for a given emergency sign. Such design considerations include, but are not limited to, the minimum amount of LEDs necessary for adequate illumination of a given emergency sign.

A resistor 24 is connected between the positive output lead of rectifying bridge 10 and the positive terminal of a rechargeable battery 32. The resistance value of resistor 24 is chosen so that an appropriate charging current is provided to rechargeable battery 32 when power is being supplied by isolating transformer 5 through rectifying bridge 10. The appropriate charging current is dependent on the characteristics of rechargeable battery 32. The charging current needed is less than the current needed to operate LEDs 28, so the effect on LEDs 28 is minimal. Rechargeable battery 32 may be a number of batteries including, but not limited to, a lead acid battery, a NiCad battery, or a NiMH battery. Likewise, rechargeable battery 32 may be a number of voltages and a number of storage capacities. The particular voltage and storage capacity chosen may depend on a number of design considerations, such as, but not limited to, the number and type of LEDs 28, the desired duration that battery 32 should power LEDs 28, and the desired brightness at which LEDs 28 should illuminate when being powered by battery 32.

A resistor 34 is connected between the negative terminal of rechargeable battery 32 and the negative output lead of rectifying bridge 10. In some embodiments, the negative terminal of rechargeable battery 32 is connected directly to the negative output lead of rectifying bridge 10 and resistor 34 is omitted. An anode of a diode 26 is connected to the positive terminal of battery 38 and a cathode of diode 26 is connected to the positive output lead of rectifying bridge 10. When power is being supplied by isolating transformer 5 and through rectifying bridge 10, the voltage at the cathode of diode 26 is not less than the voltage at the anode of diode 26 and current is prevented from flowing from battery 32 through diode 26. When power is not being supplied by isolating transformer, whether due to test switch 7 being placed in the open position or due to a power failure, the voltage at the anode of diode 26 is higher than the voltage at the cathode of diode 26. This allows current to flow from rechargeable battery 32, through diode 26, and through LEDs 28. Thus, a simple circuit allows for charging of rechargeable battery 32 and powering of LEDs 28 when power is supplied to the circuit through rectifying bridge 10 and allows rechargeable battery to power LEDs 28 in the case of a power failure.

Figure 2:
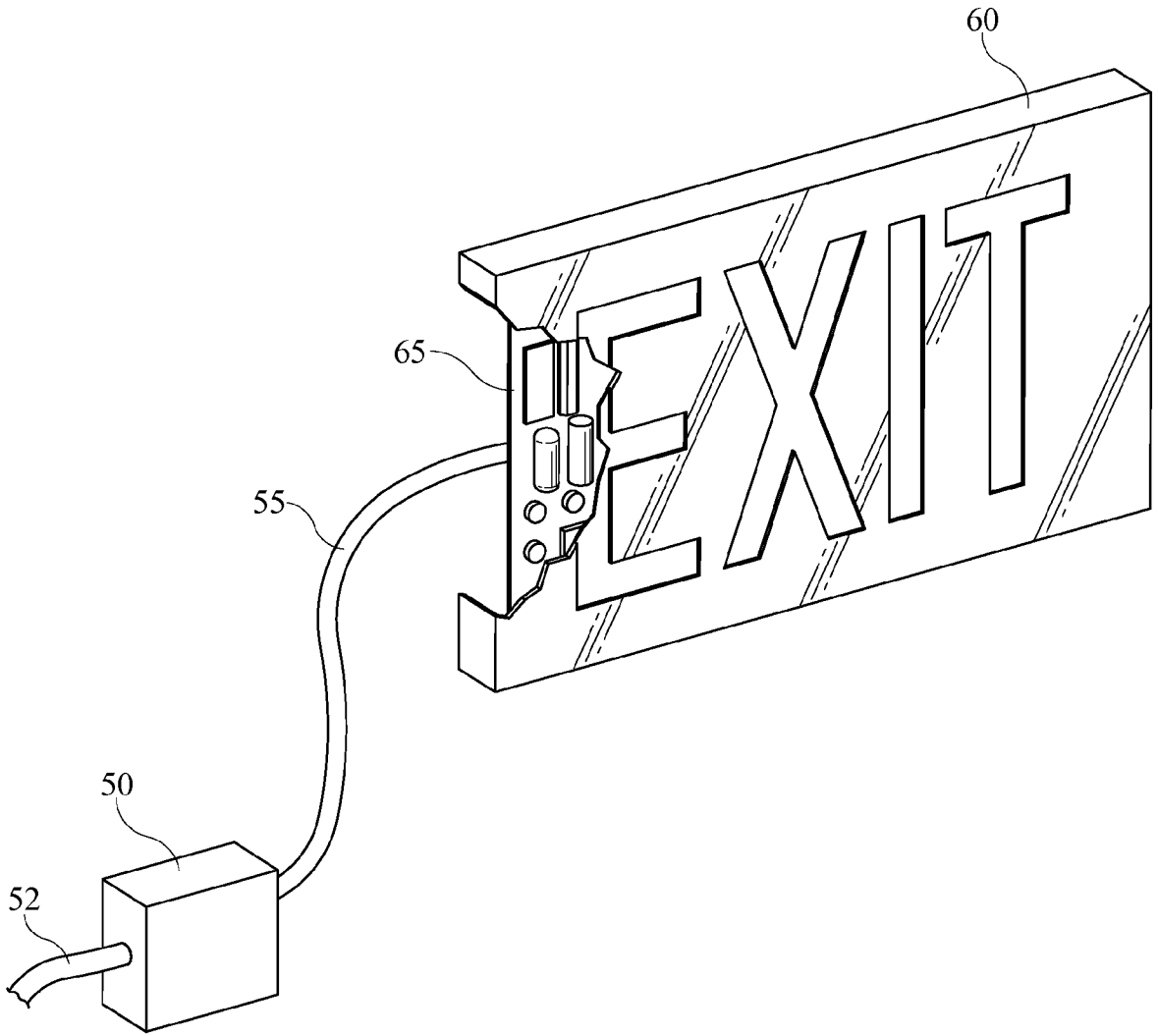
FIG. 2 is a perspective view of a fire proof enclosure housing an isolating transformer and a non-fire proof exit sign enclosure housing a circuit board having the necessary components for a low voltage/low energy emergency sign power supply with battery charger.

In some embodiments isolating transformer 5 is enclosed in a flame resistant material. In those embodiments, if rechargeable battery 32 is internally fused and/or limited to eight amps or less of current, then the emergency sign power supply with battery charger may be classified as entirely low voltage/low energy. This classification enables the circuit to be enclosed separate from isolating transformer 5 in a less expensive non-flame-resistant material and still conform to industry regulations. For example, referring now to FIG. 2, fire proof enclosure 50 houses isolating transformer 5. Electrical conduit 52 extends from fire proof enclosure 50 and contains wiring electrically coupled to isolating transformer 5 and a line voltage (not shown). Electrical conduit 55 also extends from fire proof enclosure 50 and contains wiring electrically coupled to isolating transformer 5 and to circuit board 65. Circuit board 65 is enclosed in non-fire proof exit sign enclosure 60 and the necessary components needed to construct a low voltage/low energy emergency sign power supply with battery charger are coupled thereto. The components shown on circuit board 65 in FIG. 2 are for exemplary purposes only. Fire proof enclosure 50, non-fire proof exit sign enclosure 60, and circuit board 65 are provided for exemplary purposes only. Many variations in the size, shape, and design of each are possible. For example, non-fire proof exit sign enclosure 60 could be a number of different sizes, shapes, or contain different lettering or symbols.

The foregoing description has been presented for purposes of illustration. It is not intended to be exhaustive or to limit the invention to the precise forms disclosed, and obviously many modifications and variations are possible in light of the above teaching. It is understood that while certain forms of the emergency sign power supply with battery charger have been illustrated and described, it is not limited thereto except insofar as such limitations are included in the following claims and allowable functional equivalents thereof.

We claim:

1. An emergency sign power supply connected to an isolating transformer, comprising:

an isolating transformer;

a bridge rectifier having an input connected to said isolating transformer, said bridge rectifier having a first output and a second output;

a plurality of LED branches connected in parallel with one another and connected to said first output and said second output of said bridge rectifier, each said LED branch including at least one LED;

a battery having a first battery terminal and a second battery terminal, said second battery terminal connected to said second output of said bridge rectifier;

a first resistor connected between said first output of said bridge rectifier and said first battery terminal;

a first diode having an anode and a cathode, said anode connected to said first battery terminal and said cathode directly connected to said first output of said bridge rectifier.

2. The emergency sign power supply of claim 1, wherein said LED branches each include a plurality of diodes.

3. The emergency sign power supply of claim 1, wherein said LED branches each include an identical number of LEDs.

4. The emergency sign power supply of claim 1, wherein said LED branches each include a branch resistor connected in series with each said LED.

5. The emergency sign power supply of claim 1 further comprising a fire proof enclosure housing said isolating transformer.

6. The emergency sign power supply of claim 1, further comprising a first capacitor connected across said first output and said second output of said bridge rectifier.

7. The emergency sign power supply of claim 6, wherein said LED branches each include a branch resistor connected in series with each said LED.

8. An emergency sign power supply connected to an isolating transformer, comprising:

a bridge rectifier having an input for connection to the isolating transformer, said bridge rectifier having a first output and a second output;

a plurality of LED branches connected in parallel with one another and connected to said first output and said second output of said bridge rectifier, each said LED branch including at least one LED;

a battery having a first battery terminal and a second battery terminal, said second battery terminal connected to said second output of said bridge rectifier;

a first resistor connected between said first output of said bridge rectifier and said first battery terminal;

a first diode having an anode and a cathode, said anode connected to said first battery terminal and said cathode directly connected to said first output of said bridge rectifier;

a non-flame-resistant enclosure housing said bridge rectifier, said LED branches, said battery, said first resistor, and said first diode.

9. The emergency sign power supply of claim 8, further comprising a first capacitor housed in said non flame resistant enclosure, said first capacitor connected across said first output and said second output of said bridge rectifier.

10. The emergency sign power supply of claim 8, wherein said battery is limited to eight amps or less of current.

11. The emergency sign power supply of claim 8, wherein said battery is internally fused.

12. The emergency sign power supply of claim 8 further comprising a fire proof enclosure housing said isolating transformer.

13. An emergency sign power supply connected to an isolating transformer, consisting of:

a bridge rectifier having an input for connection to the isolating transformer, said bridge rectifier having a first output and a second output;

a plurality of LED branches connected in parallel with one another and connected to said first output and said second output of said bridge rectifier, each said LED branch including at least one LED;

a battery having a first battery terminal and a second battery terminal, said second battery terminal connected to said second output of said bridge rectifier;

a first resistor connected between said first output of said bridge rectifier and said first battery terminal;

a first diode having an anode and a cathode, said anode connected to said first battery terminal and said cathode directly connected to said first output of said bridge rectifier.

14. The emergency sign power supply of claim 13, wherein said LED branches each include a branch resistor connected in series with each said LED.

15. The emergency sign power supply of claim 13 further comprising a fire proof enclosure housing said isolating transformer.

16. The emergency sign power supply of claim 13, wherein said LED branches each include a plurality of diodes.

17. The emergency sign power supply of claim 16, wherein said LED branches each include an identical number of LEDs.

18. The emergency sign power supply of claim 17, wherein said LED branches each include a branch resistor connected in series with each said LED.

19. An emergency sign power supply connected to an isolating transformer, consisting of:

a bridge rectifier having an input for connection to the isolating transformer, said bridge rectifier having a first output and a second output;

a first capacitor connected across said first output and said second output of said bridge rectifier;

a plurality of LED branches connected in parallel with one another and connected to said first output and said second output of said bridge rectifier, each said LED branch including at least one LED;

a battery having a first battery terminal and a second battery terminal, said second battery terminal connected to said second output of said bridge rectifier;

a first resistor connected between said first output of said bridge rectifier and said first battery terminal;

a first diode having an anode and a cathode, said anode connected to said first battery terminal and said cathode directly connected to said first output of said bridge rectifier.

20. The emergency sign power supply of claim 19 further comprising a fire proof enclosure housing said isolating transformer.

* * * * *